US005439350A

United States Patent [19]

Yu

[11] Patent Number: 5,439,350

[45] Date of Patent: Aug. 8, 1995

[54] HOUSING FOR CEILING FAN

[76] Inventor: Jack Yu, No. 109-1, Avenue 6, Lane 164, Tzong Sa Road, Da Du Hsiang, Taichung Hsien, Taiwan

[21] Appl. No.: 329,640

[22] Filed: Oct. 26, 1994

[51] Int. Cl.[6] ..... F04D 29/00

[52] U.S. Cl. ..... 416/5; 416/93 R; 417/423.14; 310/89

[58] Field of Search ..... 416/5, 93 R, 170 R; D23/377, 379, 385, 411; 417/423.14; 310/89; 362/147, 363, 367

[56] References Cited

U.S. PATENT DOCUMENTS

D. 262,570 1/1982 Lock ..... 416/170 R 4,863,346 9/1989 Lin ..... 416/93 R

*Primary Examiner*—Edward K. Look

*Assistant Examiner*—James A. Larson

*Attorney, Agent, or Firm*—Morton J. Rosenberg; David I. Klein

[57] ABSTRACT

A housing for a ceiling fan includes a cylindrical member and a bottom plate. A cap is engaged on the cylindrical member. A frame includes a ring element and a number of extensions radially extended outward from the ring element for engaging with the bottom plate. A number of bolts couple the bottom plate, the cap and the frame together. Panels having two flanges engaged with the cap and extensions are secured by the bolts to the outside of the cylindrical member. The extensions and the panels can be easily formed with different patterns for decoration purposes and can be easily replaced with extensions and panels of different patterns.

2 Claims, 2 Drawing Sheets

HOUSING FOR CEILING FAN

BACKGROUND OF THE INVENTION

1. Field of the Invention

The present invention relates to a housing, and more particularly to a housing for ceiling fans.

2. Description of the Prior Art

Typical ceiling fan housings comprising a lower cap, an upper cap and a cylindrical member clamped between the lower cap and the upper cap for housing the motor of the ceiling fan. The cylindrical member is normally made of glass materials and is normally formed, by molding processes, with three-dimensional or spatial patterns thereon for decorative purposes. However, the spatial patterns can not be easily changed due to the expensive and definitive molds. In addition, the cylindrical members are made of glass material such that the color of the spatial patterns also can not be easily changed.

The present invention has arisen to mitigate and/or obviate the afore-described disadvantages of the conventional ceiling fan housings.

SUMMARY OF THE INVENTION

The primary objective of the present invention is to provide a housing for a ceiling fan in which no spatial patterns are required to be formed on the cylindrical member and the decorative patterns can be easily changed.

In accordance with one aspect of the invention, there is provided a housing for a ceiling fan comprising a body including a cylindrical member and a bottom plate having an opening formed therein, a cap engaged on the body, a frame including a ring element aligned with the opening of the bottom plate and a plurality of extensions radially extended outward from the ring element for engaging with the bottom plate, and means for coupling the body, the cap and the frame together.

A plurality of panels are further provided for engaging with the cylindrical member, the panels each including two flanges extended in perpendicular to the panels for engaging with the cap and the extensions respectively and engaging with the coupling means so as to be secured to the body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
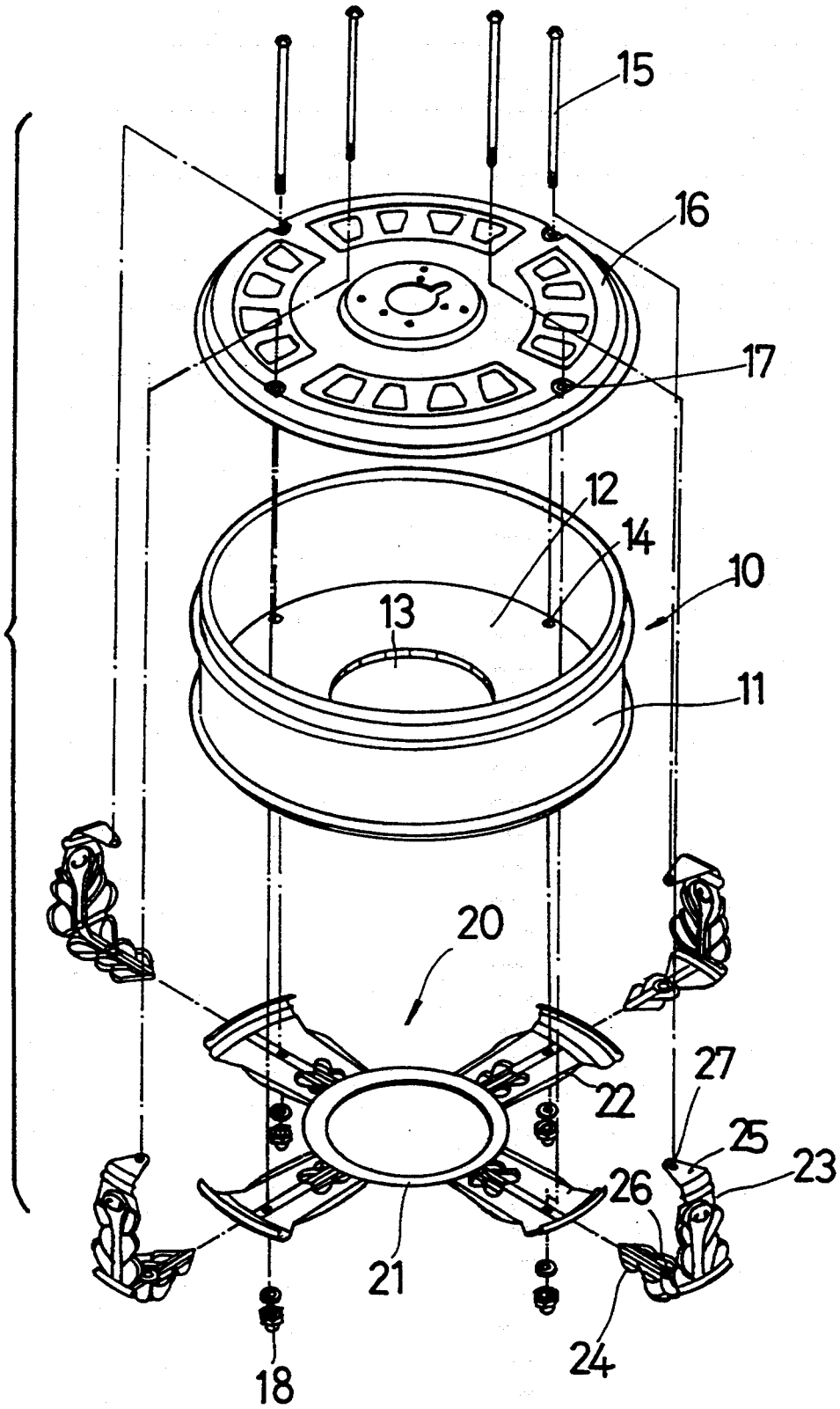
FIG. 1 is an exploded view of a housing for a ceiling fan in accordance with the present invention.
Figure 2:
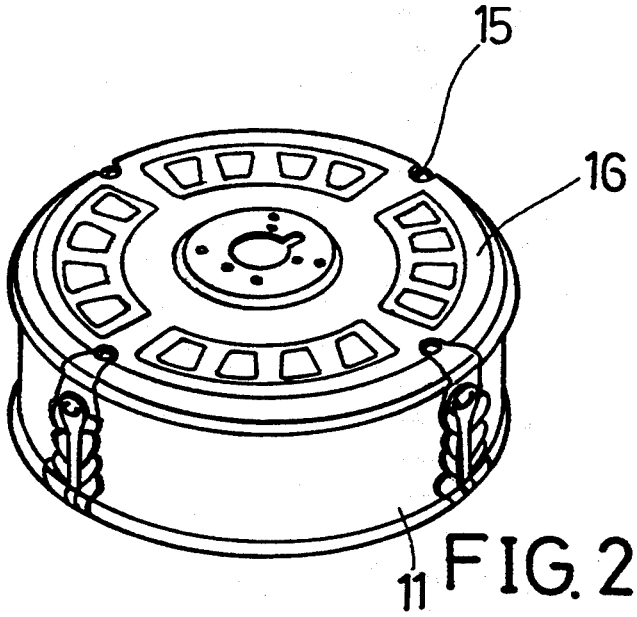
FIG. 2 is an upper perspective view of the ceiling fan housing.

Referring to the drawings, a housing in accordance with the present invention is provided for receiving the motor of the ceiling fans and comprises a body 10 which is preferably made of transparent materials including a cylindrical member 11 and a bottom plate 12. The bottom plate 12 includes an opening 13 formed in the center portion for insertion of a control box of the ceiling fan, and a number of holes 14 for engaging with bolts 15 which engage with holes 17 of a cap 16 and threaded with nuts 18 so as to secure the cap 16 and the body 10 in place. It is to be noted that the cylindrical member 11 and the bottom plate 12 are both formed with flat and smooth outer surface such that the body 10 can be easily manufactured.

Figure 3:
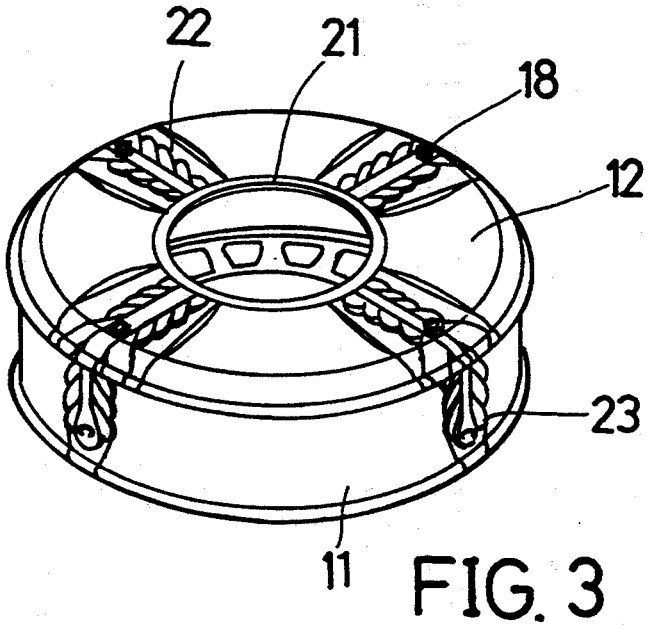
FIG. 3 is a bottom perspective view of the ceiling fan housing.

The housing further includes a frame 20 having a ring element 21 and a number of extensions 22 extended radially outward from the ring element 21 for engaging with the bottom plate 12, best shown in FIG. 3. The ring element 21 is aligned with the opening 13 of the bottom plate 12. A number of panels 23 are provided for engaging with the outer peripheral surface of the cylindrical member 10 and each includes two flanges 24, 25 extended in perpendicular to the panels 23 for engaging with the extensions 22 and the cap 16 respectively. The bolts 15 may engage with the extensions 22 and the flanges 24, 25 of the panels 23 so as to secure the elements together.

It is to be noted that the extensions 22 and the panels 23 can be easily formed with spatial patterns thereon for decoration purposes. The frame 20 and the panels 23 can be formed with different patterns and colors and can be replaced for changing different patterns.

Accordingly, the ceiling fan housing in accordance with the present invention includes a body that can be easily manufactured and includes a frame and panels that can be easily formed with different patterns and can be easily changed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A housing for a ceiling fan comprising:

a body including a cylindrical member and a bottom plate having an opening formed therein, a cap engaged on said body, a frame including a ring element aligned with said opening of said bottom plate and a plurality of extensions radially extended outward from said ring element for engaging with said bottom plate, and means for coupling said body, said cap and said frame together.

2. A housing according to claim 1 further comprising a plurality of panels for engaging with said cylindrical member, said panels each including two flanges extended in perpendicular to said panels for engaging with said cap and said extensions respectively and engaging with said coupling means so as to be secured to said body.

* * * * *